United States Patent [19]

Rieth

[11] 4,023,240

[45] May 17, 1977

[54] SPRING LOADED BUCKLES

[75] Inventor: Kurt Albert Rieth, Warwick, R.I.

[73] Assignee: Textron, Inc., Providence, R.I.

[22] Filed: May 21, 1976

[21] Appl. No.: 688,681

[52] U.S. Cl. ..... 24/188; 24/252 B

[51] Int. Cl.[2] ..... A44B 11/24

[58] Field of Search ..... 24/188, 178, 180, 241 S

[56] References Cited

UNITED STATES PATENTS

| | | | |
|---|---|---|---|
| 47,574 | 5/1865 | Saladee | 24/180 |
| 385,618 | 7/1888 | Hackett | 24/180 |
| 489,859 | 1/1893 | Dyer | 24/188 |
| 1,495,527 | 5/1924 | Rabe | 24/180 |

FOREIGN PATENTS OR APPLICATIONS

| | | | |
|---|---|---|---|
| 424,090 | 12/1910 | France | 24/180 |
| 55,105 | 1/1891 | Germany | 24/178 R |
| 12,801 | 7/1895 | United Kingdom | 24/180 |

*Primary Examiner*—Bernard A. Gelak

[57] ABSTRACT

Watch bands, bracelets, belts or similar articles which include strip means having one end adapted to be connected to a buckle. The other end of the strip means includes a series of longitudinally spaced transverse apertures. Each product also includes generally flat spring means and a buckle, one end of which includes pivot means for connecting that end of the buckle to said end of the strip means. The pivot means includes at least a portion which is of greater width than thickness. The other end of the buckle includes a cross piece having a tongue secured thereto for engagement selectively with one of the transverse apertures of the strip means when the buckle is in its closed position. The generally flat spring means engages said portion of the pivot means, so that when the buckle is rotated from its closed position towards its open position the force exerted by the flat spring means against said portion of the pivot means is increased and when the buckle is rotated in the opposite direction the flat spring means acts upon said portion of the pivot means to urge the buckle to its closed position.

19 Claims, 26 Drawing Figures

SPRING LOADED BUCKLES

BACKGROUND OF THE INVENTION

There has been a long-felt need for a watch band (which term includes a watch strap as used herein), bracelet, belt or similar article which includes a buckle for adjusting the length thereof and in which the buckle is held in both open and closed positions by spring means.

There has also been a long-felt need for such a product which is easy to operate by the user, is durable in use and is economical to manufacture.

The following patents disclose various constructions of products which include buckles and other fastening means which have not satisfied the above-described long-felt needs:

| Country | Patent No. | Date | Inventor |
|---|---|---|---|
| United States | 707,497 | Aug. 19, 1902 | Bennett |
| United States | 744,564 | Nov. 17, 1903 | Kisling et al |
| United States | 795,395 | July 25, 1905 | Jacobson |
| United States | 885,701 | Apr. 21, 1908 | Patterson |
| United States | 1,495,527 | May 27, 1924 | Rabe |
| Great Britain | 426,422 | Apr. 3, 1935 | N. C. Reading et al |
| United States | 2,072,949 | Mar. 9, 1937 | Heinze |
| Great Britain | 622,085 | Apr. 26, 1949 | Arthur Frank Napper |
| United States | 2,511,994 | June 20, 1950 | Rich |
| United States | 2,529,048 | Nov. 7, 1950 | Pease |
| United States | 3,653,100 | Apr. 4, 1972 | Dolan |

BRIEF SUMMARY OF THE INVENTION

One object of the invention is to provide an article of the character described which includes a new spring loaded buckle.

Another object is to provide such an article in which the buckle can be rotated to an open position and will remain open while the user inserts one end of the strip means through the buckle for securing the end of the strip means to the other end thereof.

A further object is to provide such an article in which the buckle is securely held in closed position.

A still further object is to provide such an article which is easy to operate by the user.

Yet another object is to provide such an article which is durable in use and economical to manufacture.

Further objects and advantages of the invention will be apparent to persons skilled in the art from the following description taken in conjunction with the accompanying drawings.

In general a product embodying this invention includes strip means having one end adapted to be connected to a buckle and its other end including a series of longitudinally spaced transverse apertures. It also includes generally flat spring means and a buckle. One end of the buckle includes pivot means for connecting that end of the buckle to one end of the strip means. The pivot means includes at least a portion which is of greater width than thickness. The other end of the buckle includes a cross piece having a tongue secured thereto for engagement selectively with one of the transverse apertures of the strip means when the buckle is in its closed position. The generally flat spring means engages said portion of the pivot means, so that when the buckle is rotated from its closed position towards its open position the force exerted by the generally flat spring means against said portion of the pivot means is increased and when the buckle is rotated in the opposite direction the generally flat spring means acts upon said portion of the pivot means to urge the buckle to its closed position.

In a preferred embodiment the end of the strip means which is connected to the buckle includes a transverse aperture adapted to be registered with one of the transverse apertures of the other end of the strip means and to receive the end of said tongue when the apertures are in registration.

In another preferred embodiment the tongue of the buckle is inclined downwardly from the cross piece of the buckle towards a portion of the end of the strip means to which the buckle is connected.

In all embodiments a surface of the generally flat spring means engages a surface of the portion of the pivot means which is of greater width when the buckle is in closed position.

In all embodiments a surface of the generally flat spring means engages a surface of the portion of the pivot means which forms the thickness thereof when the buckle is in fully open position.

In one preferred embodiment the end of the strip means which is connected to the buckle includes an upper plate means and a lower plate means and means for securing them together in spaced relationship, and the generally flat spring means and at least a portion of the pivot means are positioned in the space between the upper and lower plate means.

In a preferred embodiment the upper plate means includes a transverse aperture adapted to be registered with one of the transverse apertures of the end of the strip means and to receive the end of the tongue when such apertures are in registration.

In another preferred embodiment the buckle includes a pair of spaced side members extending in one direction from the cross piece of the buckle and the pivot means includes a member extending between the ends of the side members which are opposite to the cross piece.

In certain preferred embodiments the ends of the side members of the buckle between which the pivot means extends include apertures for slideably receiving the ends of the pivot means.

In certain preferred embodiments the buckle includes a pair of spaced side members extending in one direction from the cross piece of the buckle and the pivot means comprises a pair of tabs the first tab extending inwardly from one end of one of the side members and the second tab extending inwardly from one end of the other of the side members in a direction towards the first tab.

In other preferred embodiments the end of the strip means to which the buckle is connected includes a pair of downwardly extending spaced flanges which include apertures for rotatably receiving the pivot means.

In yet another preferred embodiment the strip means includes a pair of downwardly extending spaced flanges which contain U-shaped slots for rotatably receiving the pivot means.

In a still further embodiment the generally flat spring means is secured to the end of the strip means to which the buckle is connected by tab means which extend inwardly from spaced flanges on said end of the strip means beneath the ends of the generally flat spring means.

In another preferred embodiment the strip means includes a pair of downwardly extending spaced flanges which contain U-shaped slots for rotatably receiving the pivot means and one edge of each of the downwardly extending tabs provides a cam for guiding the pivot means into the U-shaped slots when it is slid along the upper surface of the flat spring means towards the slots.

In another embodiment the generally flat spring means is integral with the end of the strip means to which the buckle is connected and includes a resilient member which extends beneath that one end of the strip means for engagement with the pivot means.

In yet another embodiment the generally flat spring means includes a plate member which includes centrally disposed resilient tongue means and a pair of side members, each of which is provided at its end with generally cylindrical means for rotatably receiving the pivot means, and the end of the strip means to which the buckle is connected includes a loop which surrounds the generally flat spring means.

It will be apparent to persons skilled in the art that this invention has solved the above-described long-felt need and satisfied the above-described objects.

DETAILED DESCRIPTION OF THE FIRST EMBODIMENT

While the invention includes watch bands, bracelets, belts and similar products the operative lengths of which are to be adjusted, the embodiment shown in FIGS. 1 through 9 shows the invention incorporated in a two-piece metal watch band.

The strip means shown in FIGS. 1 through 9 is generally indicated by the numeral 30 and it comprises two strips of metal 31A and 31B such as stainless steel and a wrist watch 31C which is pivotally connected between the two strips of metal by spring pins 31D and 31E, the operation of which is well known in the art.

Figure 3:
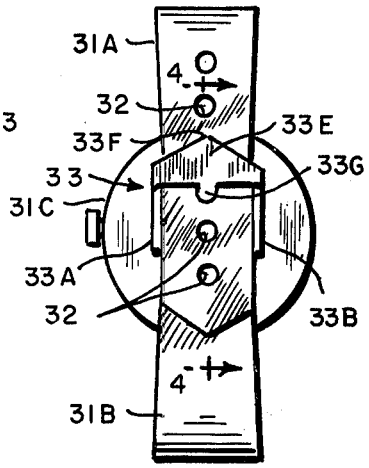
FIG. 3 is a plan view looking from right to left at the watch and watch band of FIG. 1.

The end 31A of the strip means 30 is provided with a series of longitudinally spaced transverse apertures 32 (FIG. 3).

Figure 4:
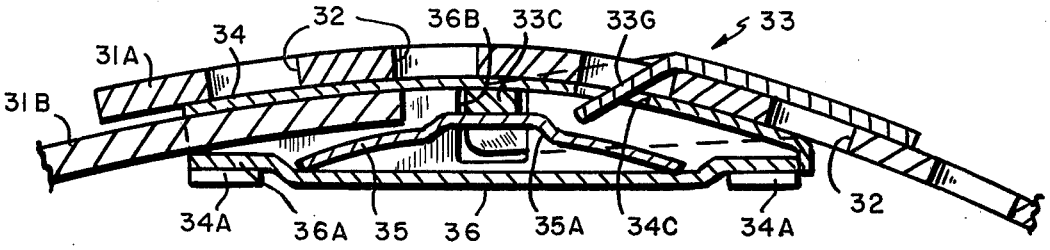
FIG. 4 is an enlarged section on the line 4—4 of FIG. 3.

The other end 31B of the strip means includes a buckle which is indicated generally by the numeral 33. The buckle comprises a pair of spaced side members 33A and 33B which are connected together at one set of their ends by the pivot means 33C. This pivot means is generally rectangular in transverse section and is of greater width than thickness for reasons which are described below. The other set of ends of the side members 33A, 33B are connected together by a cross piece 33E which is provided with a pointed fingernail piece 33F and a centrally disposed tongue 33G. The tongue 33G is inclined downwardly from the cross piece as shown in FIGS. 4, 5 and 6.

The buckle is connected to one end 31B of the strip means 30 by the upper cover 34, the generally flat spring 35 and the lower cover 36. In closed position of the buckle the central raised portion 35A of the flat spring is positioned below and in face-to-face engagement with the lower flat surface of the pivot means and urges it into face-to-face engagement with the lower surface of the upper cover as shown in FIG. 4. The elements are secured in these positions by bending the ends of the tabs 34A and 34B of the upper cover inwardly beneath the lower cover 36 so that they are positioned in the depressed border 36A thereof. In assembled position the pivot means 33C passes through the slot 34D in the side walls of the upper cover 34 and the slots 36B in the lower cover 36.

The upper cover 34 is provided with a transverse aperture 34C adjacent to one of its ends.

Figure 5:
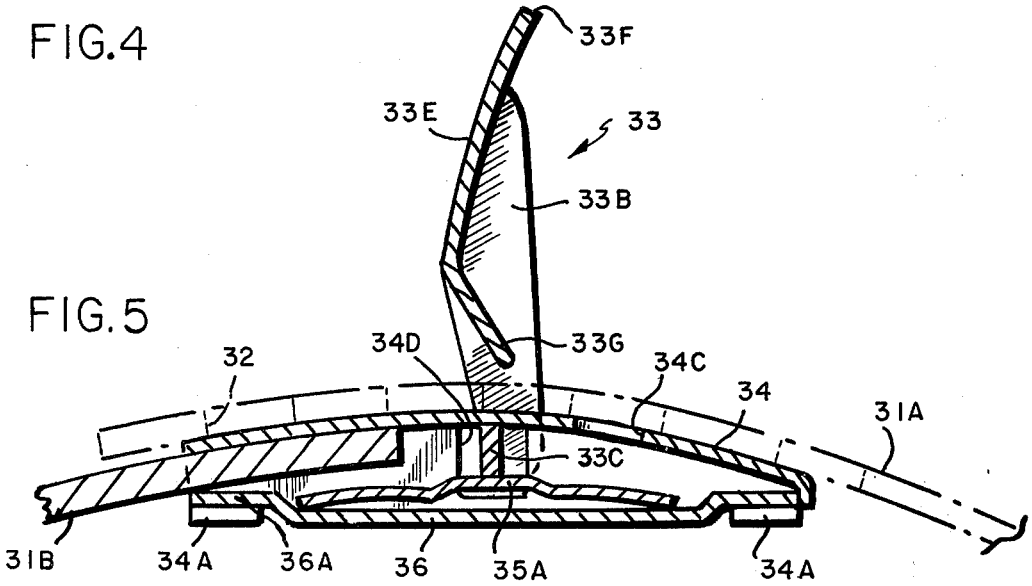
FIG. 5 is a section like FIG. 4 but showing the buckle in open position.
Figure 6:
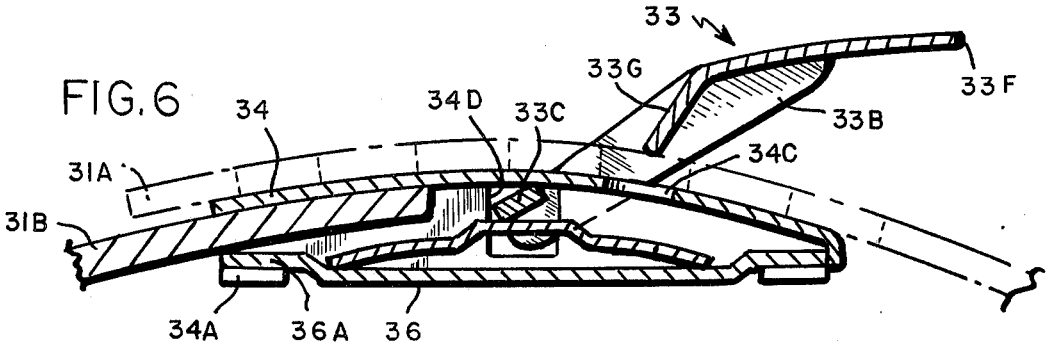
FIG. 6 is a section like FIG. 5 but with the end of the tongue of the buckle resting upon the surface of a portion of the strip means between two of the apertures in one end of the strip means.
Figure 7:
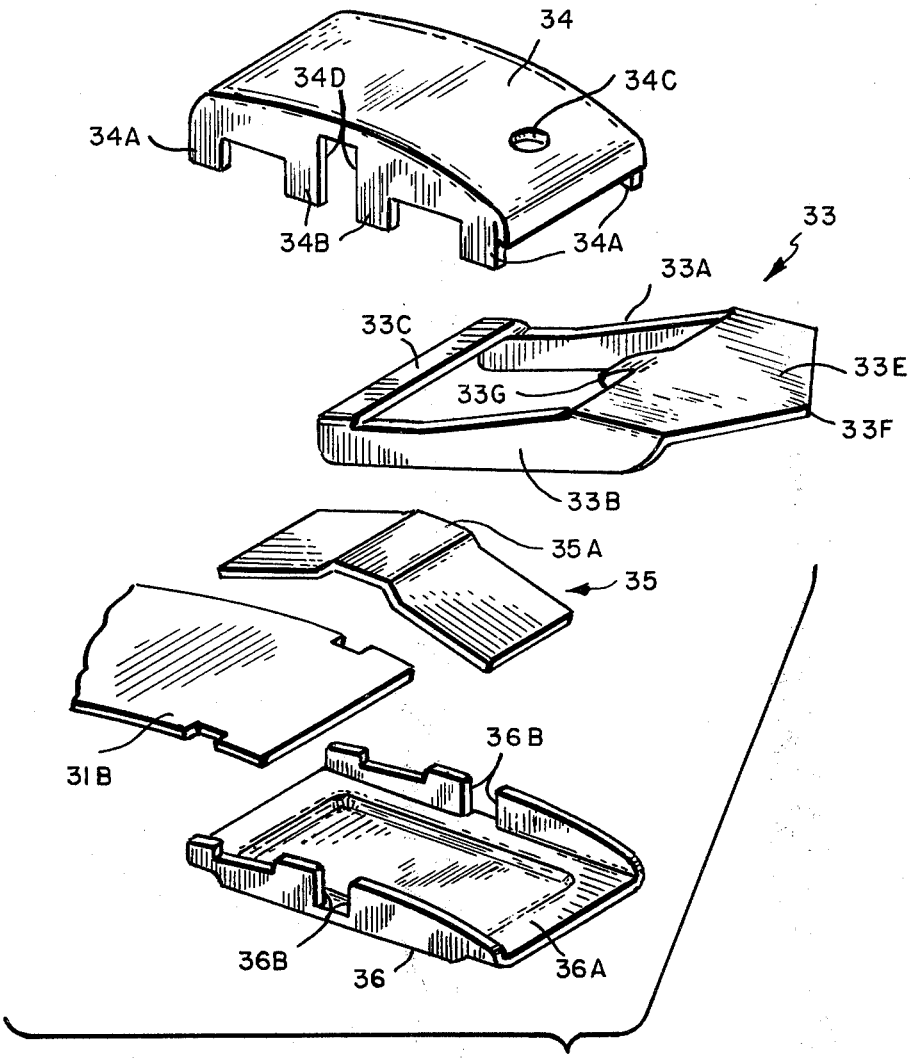
FIG. 7 is an exploded view showing one end of the strip means, a generally flat spring, upper and lower plate means and a buckle in positions to be assembled.
Figure 8:
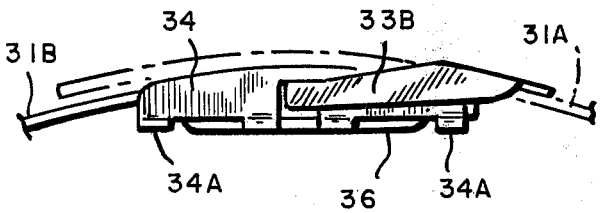
FIG. 8 is an enlarged side elevation showing the assembled buckle and strip means with the buckle in closed position.
Figure 9:
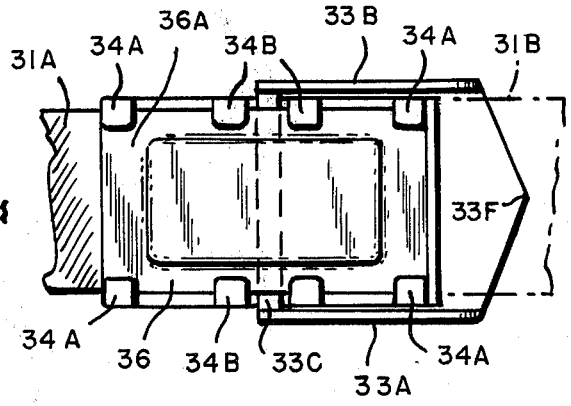
FIG. 9 is a bottom view of the elements shown in FIG. 8.

In use the buckle is first rotated to the open position shown in FIG. 5. Because the pivot means 33C is generally rectangular in cross section and is of greater width than thickness, when the buckle is rotated from its closed position of FIG. 4 to its open position of FIG. 5 it depresses the central portion 35A of the flat spring and the force created by the flat spring against the pivot means is progressively increased so that when the pivot means reaches the position of FIG. 5 it is held in its open position by engagement of the narrow side of the pivot means with the lower surface of the upper cover 34.

Then the end 31A of the strip means 30 is slid through the opening in the buckle until the selected aperture 32 registers with the aperture 34C of the cover 34. The buckle 33 is then rotated from its open position of FIG. 5 to its closed position of FIG. 4 and during such movement the end of the tongue 33G passes through the registering apertures 32 and 34C. During this closing movement the leaf spring 35 urges the buckle to closed position by acting upon the pivot means 33C and an audible click can be heard when the buckle reaches fully closed position.

The length of the strip means 30 can be adjusted by the user without removing the end 31A of the strip means from the buckle. To do this the user inserts his fingernail beneath the pointed fingernail piece 33F and rotates the buckle slightly about its pivotal connection to the end 31A to remove the tongue 33G from the registering apertures. Then the end 31A of the strip means is slid either farther inwardly through the opening in the buckle or farther outwardly through that opening until the tongue is urged by the spring 35 through a different aperture 32 and thence through the aperture 34C of the upper cover. During this sliding movement of the end 31A of the strip means the tip of the tongue 33G rides along the upper surface of the strip 31A between pairs of apertures 32 as shown in FIG. 6. The pressure of the flat spring against the pivot means urges the buckle to closed position during such movement but permits the end 31A of the strip means 31 to be slid from one aperture 32 to another aperture 32 by merely continuing the longitudinal pressure on the end 31A of the strip means when the strip means is moved in a direction to shorten the length of the watch band because of the angle of the tongue 33G relative to the surface of the cross member 33E. However when the end 31A of the strip means 30 is moved in a direction to enlarge the size of the strip means it is necessary to raise the buckle by means of the user's fingernail to cause the tongue to be moved outwardly of the registering apertures. Thus the watch band is firmly held against separation in its finally adjusted position.

It will be apparent to persons skilled in the art that the buckle shown in FIGS. 1 to 9 can be readily assembled with an identification bracelet which does not include a wrist watch and that it will operate in the same manner. It will also be apparent that the buckle can be assembled with two-piece leather, plastic or fabric watch bands or watch straps and with a one-piece belt and that it will function in the same manner as with a two-piece metal watch band.

DETAILED DESCRIPTION OF THE SECOND EMBODIMENT

Figure 10:
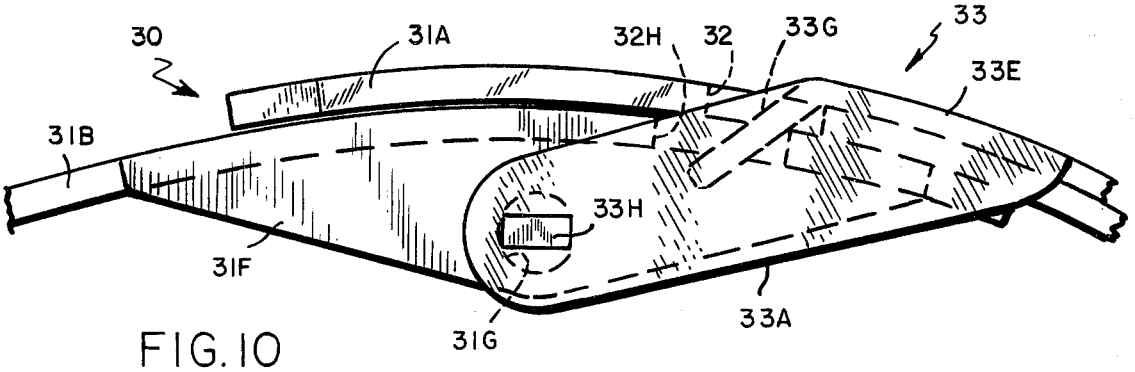
FIG. 10 is an enlarged side elevation of another embodiment of the invention with the buckle in closed position.
Figure 11:
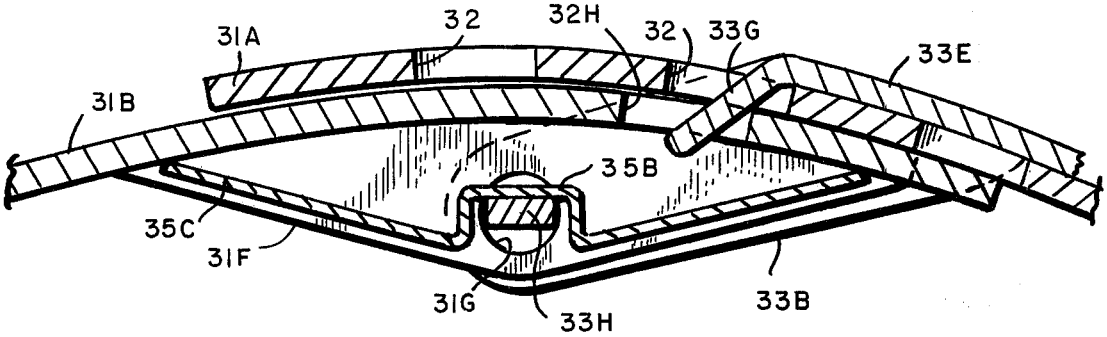
FIG. 11 is a central longitudinal section of the embodiment shown in FIG. 10.
Figure 12:
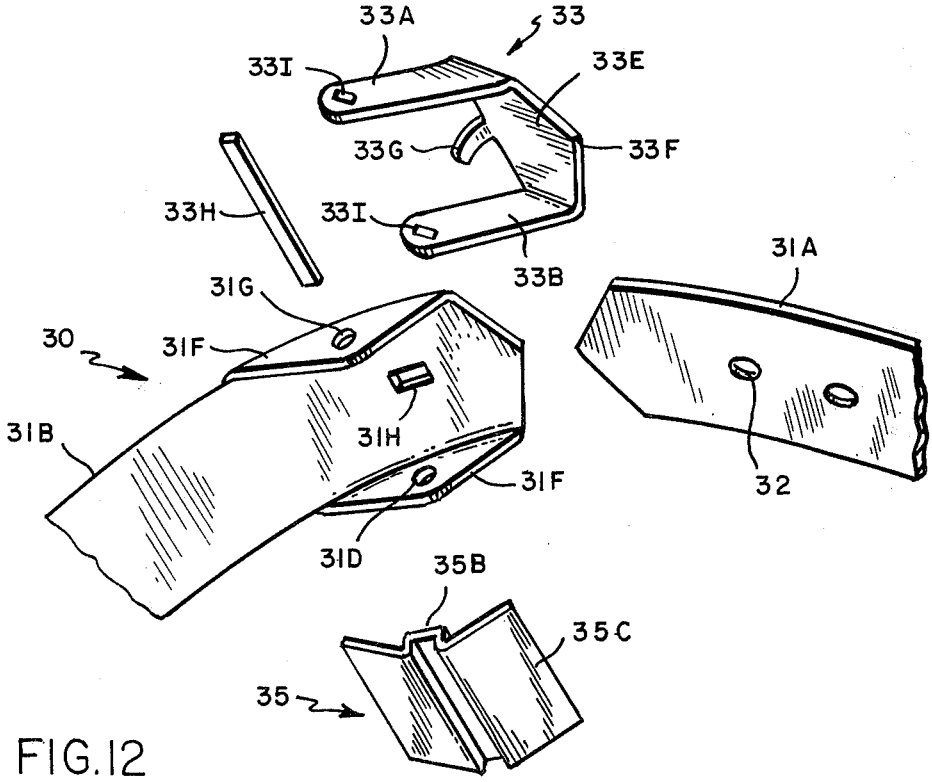
FIG. 12 is an exploded view showing two ends of the strip means, a generally flat spring means and the elements of the buckle in positions to be assembled with one end of the strip means and the generally flat spring means.
Figure 13:
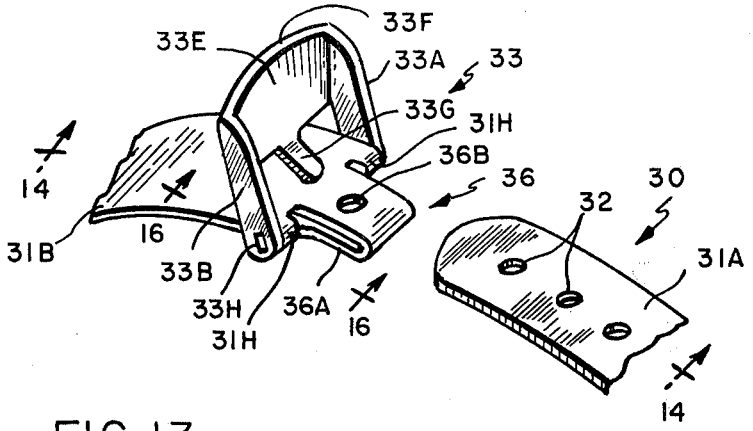
FIG. 13 is an isometric view of another embodiment of the invention showing two ends of the strip means and a buckle in open position.

The second embodiment is shown in FIGS. 10 through 12 of the drawings.

This embodiment is generally similar to the first embodiment except that it does not include upper and lower plate means for housing the generally flat spring means and the major portion of the pivot means.

The same numerals are used to designate those elements which are the same as in the first embodiment.

Figure 1:
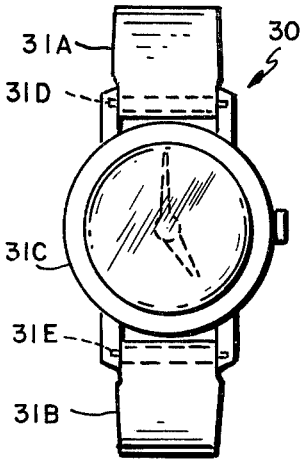
FIG. 1 is a plan view of a product embodying this invention in which the strip means has a wrist watch incorporated therein intermediate its ends.
Figure 2:
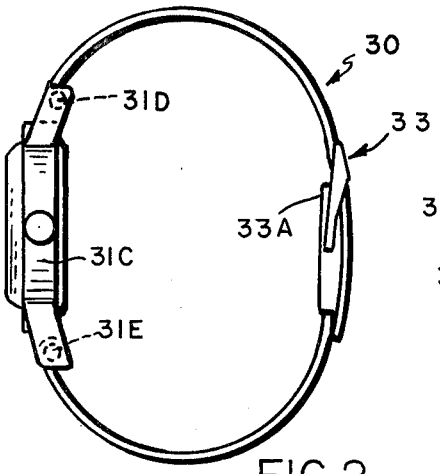
FIG. 2 is a side elevation looking from right to left at the watch and watch band of FIG. 1 with the buckle in closed position.

The strip means is generally indicated by the numeral 30 and it comprises two strips of metal 31A and 31B and a wrist watch (not shown) which is pivotally connected between the two strips of metal in the same manner as is illustrated in FIGS. 1 and 2 of the drawings.

One end of the strip means 30 is provided with a series of longitudinally spaced transverse apertures 32.

The other end of the strip means includes a buckle which is indicated generally by the numeral 33. The buckle comprises a pair of spaced side members 33A and 33B one set of the ends of which are connected together by a cross piece 33E which is provided with a pointed fingernail piece 33F and a centrally disposed tongue 33G. The tongue 33G is inclined downwardly from the cross piece as shown in FIGS. 10, 11 and 12. Detachable pivot means 33H is inserted through the rectangular openings 33I in the other set of ends of the side members 33A and 33B. This pivot means is generally rectangular in transverse section and is of greater width than thickness for the same reasons stated in connection with the first embodiment.

The end 31B of the strip means is provided with a pair of downwardly extending spaced flanges 31F. These flanges are provided with circular apertures 31G. The end 31B is also provided with an aperture 31H.

The generally flat spring 35 is provided with a central raised portion 35B and upwardly inclined legs 35C.

To assemble the buckle with the end 31A of the strip means its side members 33A and 33B are placed beside the flanges 31C of the end 31A and then the pivot means 33H is inserted through one aperture 33I, thence through the apertures 31G and thence along the other aperture 33I. The ends of the pivot means are then secured to the side members 33A and 33B by welding or other suitable means.

In closed position of the buckle the central raised portion 35B of the generally flat spring is positioned above and in face-to-face engagement with the upper flat surface of pivot means 33H as shown in FIG. 11.

In use, because the pivot means 33H is generally rectangular in cross section and is of greater width than thickness, when the buckle is rotated from its closed position of FIG. 11 to its open position (not shown) it elevates the central portion 35B of the flat spring and the force created by the generally flat spring against the pivot means is progressively increased so that when the pivot means reaches its fully open position (see FIG. 5) it is held there by engagement of the narrow side of the pivot means with the lower surface of the central portion 35B of the generally flat spring.

When the buckle is rotated from its open position to its closed position of FIG. 11 the end of the tongue 33G passes through the registering apertures 32 and 31H. During this closing movement the flat spring 35 urges the buckle to closed position by acting upon the pivot means 33H and an audible click can be heard when the buckle reaches fully closed position.

The length of the strip means 30 can be adjusted in the same way as in the first embodiment.

It will be apparent to persons skilled in the art that the buckle of this embodiment can be readily assembled with an identification bracelet which does not include a wrist watch and that it will operate in the same manner.

DETAILED DESCRIPTION OF THE THIRD EMBODIMENT

This embodiment is shown in FIGS. 13 through 16 of the drawings and the same numerals are used to designate those elements which are the same as in the first embodiment.

The strip means is generally indicated by the numeral 30 and it comprises two strips of metal 31A and 31B such as stainless steel and a wrist watch (not shown) which is pivotally connected between the two strips of metal in the same manner as is shown in FIGS. 1 to 3 of the drawings.

One end 31A of the strip means 30 is provided with a series of longitudinally spaced transverse apertures 32.

Figure 14:
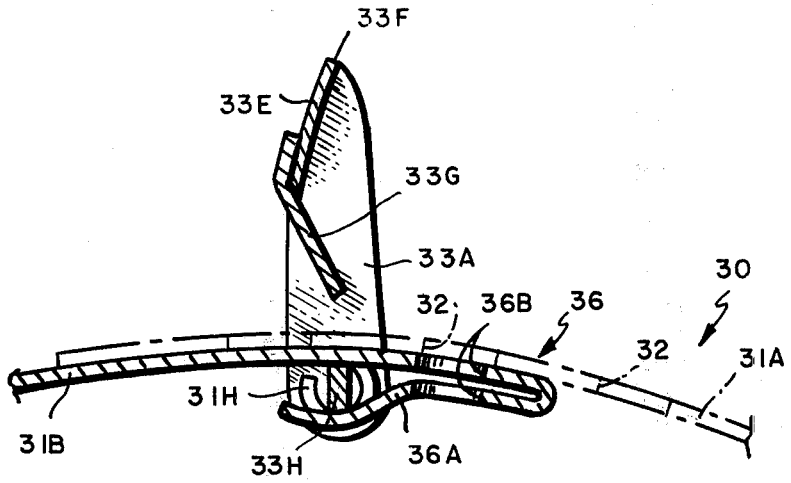
FIG. 14 is an enlarged section on the line 14—14 of FIG. 13 but with one end of the strip means extending through the open buckle.
Figure 15:
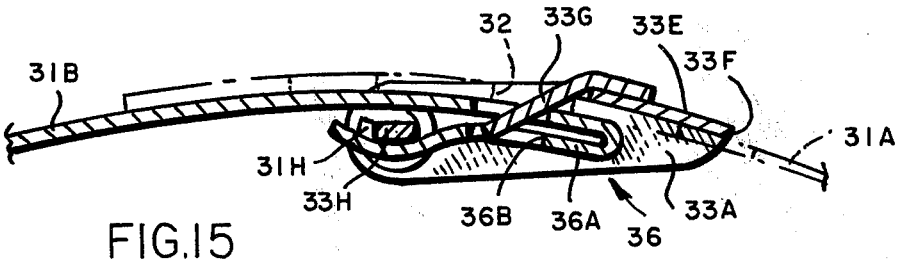
FIG. 15 is a view like FIG. 14 but with the buckle in closed position.
Figure 16:
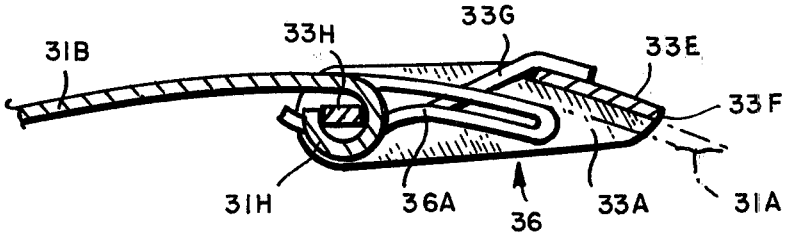
FIG. 16 is an enlarged section taken on line 16—16 of FIG. 13 but with the buckle in closed position.

The other end 31B of the strip means includes a buckle which is indicated generally by the numeral 33. The buckle comprises a pair of spaced side members 33A and 33B. The pivot means 33H extends between one set of ends of the side members 33A and 33B. This pivot means is generally rectangular in transverse section and is of greater width than thickness for the reasons which are described in connection with the first embodiment. The other set of ends of the side members 33A, 33B are connected together by a cross piece 33E which is provided with a curved fingernail piece 33F and a centrally disposed tongue 33G. The tongue 33G is inclined downwardly from the cross piece as shown in FIGS. 14, 15 and 16.

The end 31B of the strip means is provided with an integral centrally disposed projecting member 36 the lower portion of which forms a generally flat spring means 36A.

The end 31B of the strip means is also provided with a pair of spaced collars 31H which rotatably receive the pivot means 33H.

The buckle is connected to the end of the strip 31B by inserting one end of the pivot means 33H through one of the collars 31H, then between the generally flat spring 36A and the upper strip of the centrally disposed projecting member 36 and thence through the other collar 31H.

In closed position of the buckle the central depressed portion 36A of the flat spring means is positioned below and in face-to-face engagement with the lower flat surface of pivot means 33H as shown in FIG. 15.

The projecting member 36 is provided with an aperture 36B for registering with a selected aperture 32 of the end 31A of the strip means.

In use the buckle is first rotated to the open position shown in FIG. 14. Because the pivot means 33H is generally rectangular in cross section and is of greater width than thickness when the buckle is rotated from its closed position of FIG. 15 to its open position of FIG. 14 it depresses the central portion 36A of the generally flat spring and the force created by the flat spring against the pivot means is progressively increased so that when the pivot means reaches the position of FIG. 14 it is held in its open position by engagement of the narrow side of the pivot means with the lower surface of the end 31B of the strip means.

When the buckle is rotated from its open position of FIG. 14 to its closed position of FIG. 15 the end of the tongue 33G passes through the registering apertures 32 and 36B. During this closing movement the flat spring 36A urges the buckle to closed position by acting upon the pivot means 33H and an audible click can be heard when the buckle reaches fully closed position.

The length of the strip means 30 can be adjusted in the same way as in the first embodiment.

It will be apparent to persons skilled in the art that the buckle of this embodiment can be readily assembled with an identification bracelet which does not include a wrist watch and that it will operate in the same manner.

DETAILED DESCRIPTION OF THE FOURTH EMBODIMENT

Figure 17:
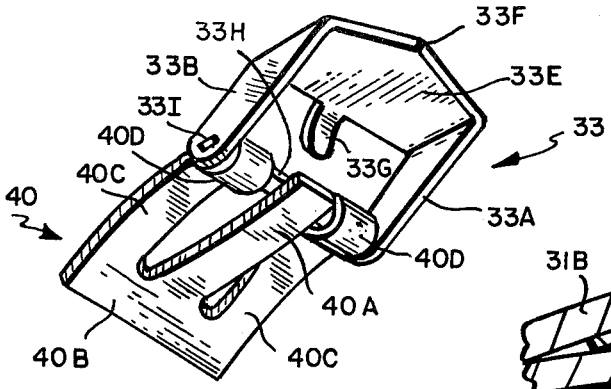
FIG. 17 is a bottom isometric view of another embodiment of the invention showing a generally flat spring means and a buckle pivotally secured to the end of the spring means.
Figure 19:
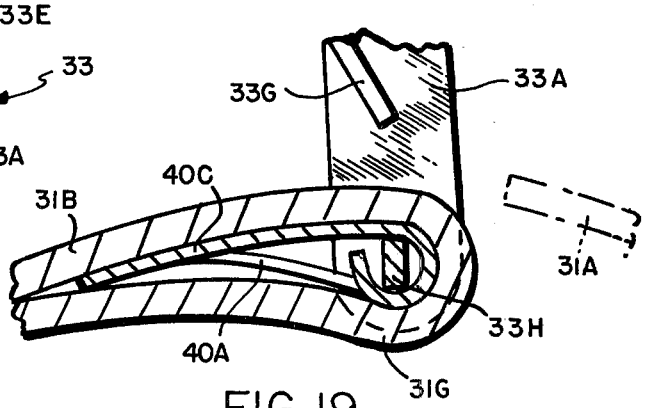
FIG. 19 is a view similar to FIG. 18 but with the buckle shown in open position before the other end of the strip means is passed through the buckle, the section being taken through one of the cylindrical loops of the flat spring means.
Figure 18:
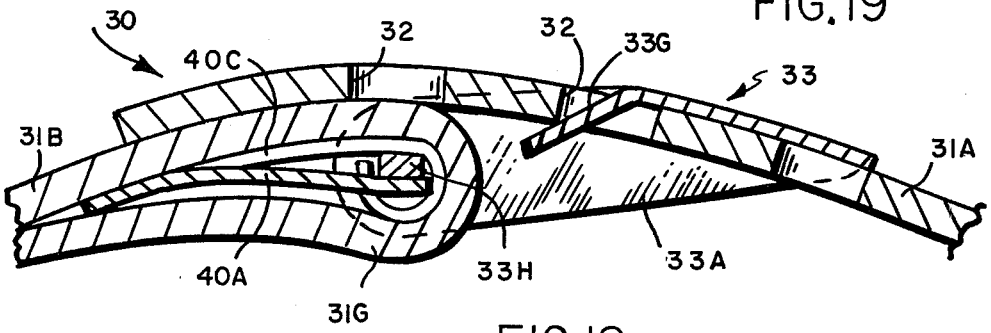
FIG. 18 is an enlarged longitudinal section of the overlapping ends of a watch band showing the elements of FIG. 17 assembled in a loop of an end of a leather, plastic or fabric strip means and the other end of the strip means passed through the buckle with the tongue of the buckle passing through an orifice in that end of the strip means.

This embodiment is shown in FIGS. 17 through 19 of the drawings and the same numerals are used to designate those elements which are the same as in the first embodiment.

The strip means is generally indicated by the numeral 30 and comprises two strips of leather, plastic, mesh or fabric 31A and 31B and a wrist watch (not shown) which is pivotally connected between the two strips 31A and 31B in the same manner as is illustrated in FIGS. 1 and 2 of the drawings.

The end 31A of the strip means is provided with a series of longitudinally spaced transverse apertures 32.

The end 31B of the strip means includes a buckle which is indicated generally by the numeral 33. The buckle comprises a pair of spaced side members 33A and 33B one set of the ends of which are connected together by a cross piece 33E which is provided with a pointed fingernail piece 33F and a centrally disposed tongue 33G. The tongue 33G is inclined downwardly from the cross piece as shown in FIGS. 17 and 18. Detachable pivot means 33H may be inserted through the rectangular openings 33I in the other set of ends of the side members 33A and 33B. This pivot means is generally rectangular in transverse section and is of greater width than thickness for the same reasons stated in connection with the first embodiment.

The end 31B of the strip means is provided with a loop 31G.

The generally flat spring 40 which may be made of stainless steel or other resilient material comprises a plate member having a central tongue 40A which projects forwardly therefrom. It also comprises a pair of side members 40C each of which is provided with a generally cylindrical loop 40D.

To assemble the generally flat spring 40 with the end 31B of the strip means 30 the loop 31G is passed about the spring 40 and the lower ply is secured to the upper ply by adhesive, stitching or other suitable means. Then the ends of the side members 33A and 33B are placed adjacent to the cylindrical loops 40D. Then one end of the pivot means 33H is inserted through one end of the rectangular apertures 31I, the loops 40D and the other aperture 31I and its outer ends are secured to the side members 33A and 33B by welding or other suitable means.

In closed position of the buckle the end of the flat spring element 40A is positioned below and in face-to-face engagement with the lower flat surface of pivot means 33H as shown in FIG. 18.

In use, because the pivot means 33H is generally rectangular in cross section and is of greater width than thickness, when the buckle is rotated from its closed position of FIG. 18 to its open position of FIG. 19 it depresses the end of the flat spring means and the force created by the flat spring against the pivot means is progressively increased so that when the pivot means reaches its fully open position (see FIG. 5) it is held there by engagement of the narrow side of the pivot means with the upper surface of the flat spring.

When the buckle is rotated from its open position of FIG. 19 to its closed position of FIG. 18 the end of the tongue 33G passes through a selected aperture 32. During this closing movement the flat spring 40A urges the buckle to closed position by acting upon the pivot means 33H.

The length of the strip means 30 can be adjusted in the same way as in the first embodiment.

It will be apparent to persons skilled in the art that the buckle of this embodiment can be readily assembled not only with a two-piece watch band but also with an identification bracelet which does not include a wrist watch and with a belt and that it will operate in the same manner.

DETAILED DESCRIPTION OF THE FIFTH EMBODIMENT

This embodiment is shown in FIGS. 20 through 23 of the drawings and the same numerals are used to designate those elements which are the same as in the first embodiment.

The strip means is generally indicated by the numeral 30 and it comprises a strip of metal 31B, another strip of metal (not shown) and a wrist watch (not shown) which is pivotally connected between the two strips of metal in the same manner as is shown in FIGS. 1 to 3 of the drawings.

One end 31A of the strip means 30 is provided with a series of longitudinally spaced transverse apertures 32 as shown in FIGS. 3 and 4 of the drawings.

The other end 31B of the strip means includes a buckle which is indicated generally by the numeral 33. The buckle comprises a pair of spaced side members 33A and 33B. The pivot means comprises two tabs 33K which extend inwardly from one set of ends of the side members 33A and 33B. They each include a portion which is generally rectangular in transverse section and is of greater width than thickness for the reasons which are described in connection with the first embodiment.

Figure 20:
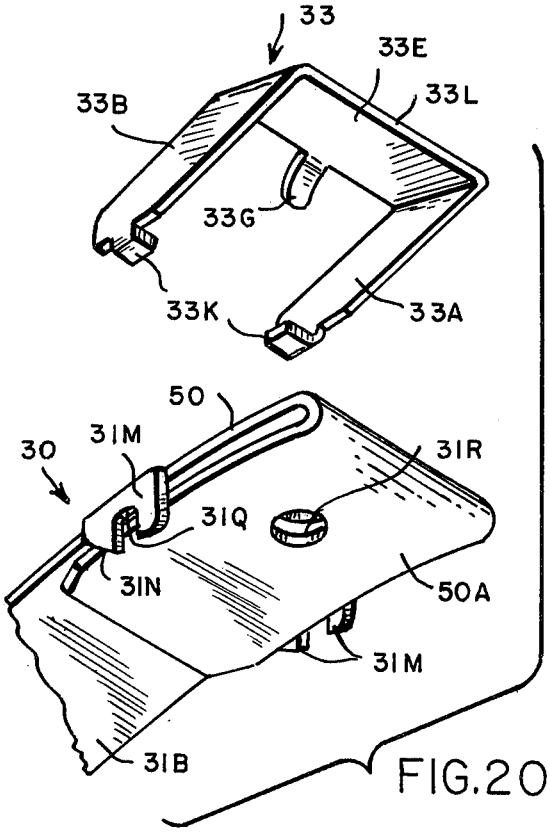
FIG. 20 is an isometric view of another embodiment of the invention showing one end of the strip means and a buckle in exploded positions.
Figure 21:
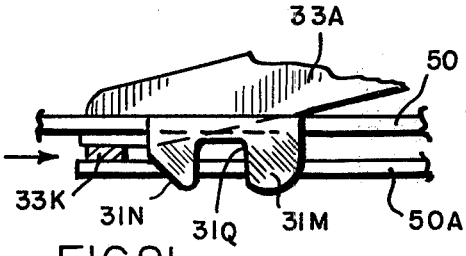
FIG. 21 is a section through one of the generally rectangular pivot means of the buckle shown in FIG. 20 with the pivot means in positions to be slid into engagement with the cam surfaces of downwardly extending tabs at the sides of the strip means.

The other set of ends of the side members 33A, 33B are connected together by a cross piece 33E the outer end of which comprises a fingernail piece 33L and the inner end of which comprises a centrally disposed tongue 33G. The tongue 33G is inclined downwardly from the cross piece as shown in FIG. 20.

The end 31B of the strip means is provided with an integral extension 50 the lower portion of which 50A forms a generally flat spring means.

The end 31B of the strip means is also provided with a pair of spaced tabs 31M each of which is provided with a cam surface 31N and a U-shaped slot 31Q.

An aperture 31R extends through the extension 50 to receive the tongue 33G of the buckle when it is in closed position (not shown).

Figure 22:
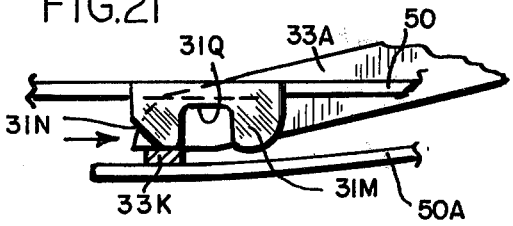
FIG. 22 shows the elements of FIG. 21 with the generally rectangular pivot means positioned between the flat spring means and one end of one of the downwardly extending tabs of the strip means.

The buckle is connected to the end 31B of the strip means by sliding the tabs 33K of the buckle between the upper surface of the generally flat spring means 50A and the lower surface of the extension 50 into contact with the cam surfaces 31N of the tabs 31M. The cam surfaces 31N act upon the tabs 33K to move them downwardly and thus to move the end of the spring means 50A downwardly as shown in FIG. 22. When the tabs 33K pass beyond the lower ends of the cam surfaces the spring means urges the tabs upwardly into the U-shaped slot 31Q and thereby to pivotally connect the buckle to the end 31B of the strip means.

In use the buckle is first rotated to the open position shown in FIG. 5 of the drawings. Because the pivot means 33K are each generally rectangular in cross section and of greater width than thickness, when the buckle is rotated from its closed position of FIG. 23 to its open position of FIG. 5, the pivot means 33K depresses the end of the generally flat spring 50A and the force created by the flat spring against the pivot means is progressively increased so that when the buckle reaches its open position it is held there by engagement of the narrow sides of the pivot means 33K with the upper surface of the generally flat spring means.

Figure 23:
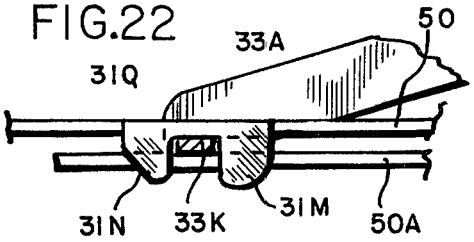
FIG. 23 shows the elements of FIG. 22 in fully assembled positions with the flat spring means urging the generally rectangular pivot means to a U-shaped slot of one of the downwardly extending tabs of the strip means.

When the buckle is rotated from its open position to its closed position of FIG. 23 the end of the tongue 33G passes through the registering apertures 32 of the strip means and the aperture 31R of the extension 50. During this closing movement the spring means 50A urges the buckle to closed position by acting upon the pivot means 33K and an audible click can be heard when the buckle reaches fully closed position.

The length of the strip means 30 can be adjusted in the same way as in the first embodiment.

It will be apparent to persons skilled in the art that the buckle of this embodiment can be readily assembled with an identification bracelet which does not include a wrist watch and that it will operate in the same manner.

DETAILED DESCRIPTION OF THE SIXTH EMBODIMENT

Figure 24:
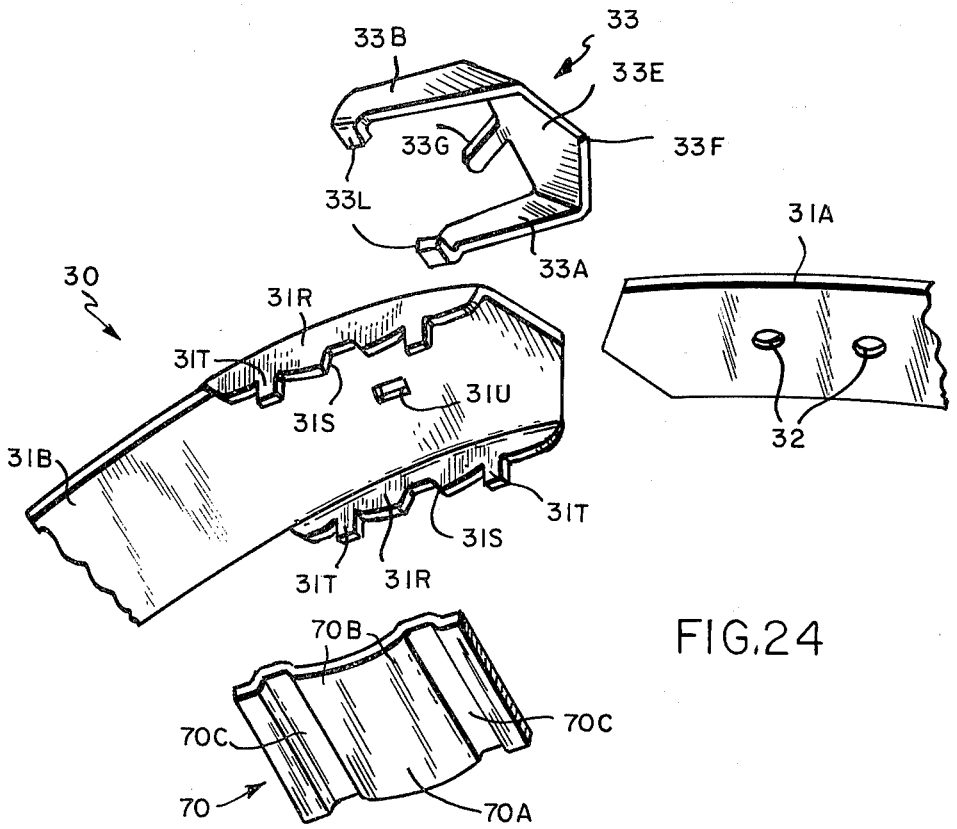
FIG. 24 is an exploded view showing two ends of the strip means, a generally flat spring means and a buckle in positions to be assembled with one end of the strip means and the generally flat spring means.
Figure 25:
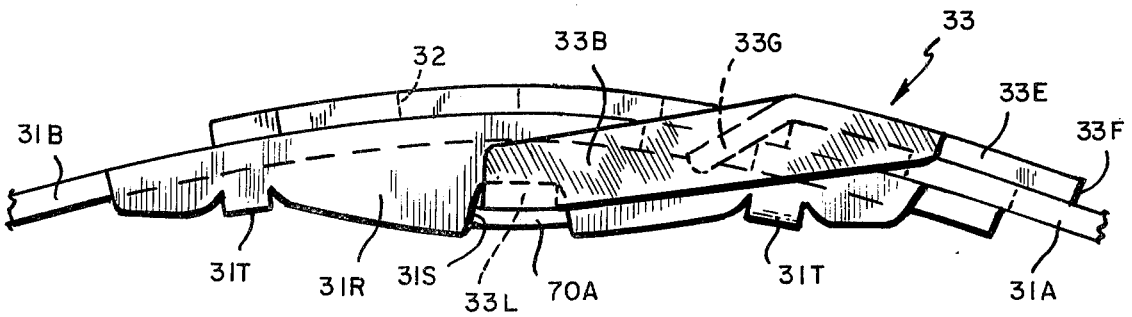
FIG. 25 is a side elevation of the elements of FIG. 24 assembled with the other end of the strip means and the buckle in closed position.
Figure 26:
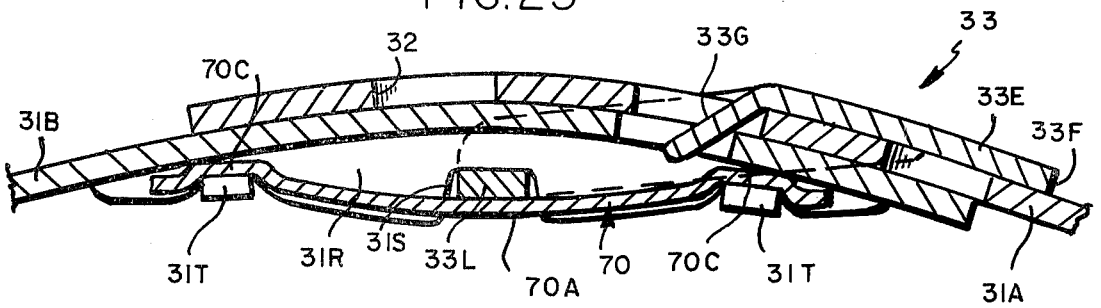
FIG. 26 is a central longitudinal section of the elements shown in FIG. 25.

This embodiment is shown in FIGS. 24 through 26 of the drawings.

This embodiment is generally similar to the second and fifth embodiments.

The same numerals are used to designate those elements which are the same as in the first, second and fifth embodiments.

The strip means is generally indicated by the numeral 30 and it comprises two strips of metal 31A and 31B and a wrist watch (not shown) which is pivotally connected between the two strips of metal in the same manner as is illustrated in FIGS. 1 and 2 of the drawings.

The end 31A of the strip means 30 is provided with a series of longitudinally spaced transverse apertures 32.

The other end 31B of the strip means includes a buckle which is indicated generally by the numeral 33. The buckle comprises a pair of spaced side members 33A and 33B one set of the ends of which are connected together by a cross piece 33E which is provided with a pointed fingernail piece 33F and a centrally disposed tongue 33G. The tongue 33G is inclined downwardly from the cross piece as shown in FIGS. 24 and 26.

The pivot means comprises two tabs 33L which extend inwardly from one set of ends of the side members 33A and 33B. They each include a portion which is generally rectangular in transverse section and is of greater width than thickness for the reasons which are described in connection with the first embodiment.

The end 31B of the strip means is provided with a pair of downwardly extending spaced flanges 31R. The flanges are provided with U-shaped slots 31S and tabs 31T. The end 31B is provided with an aperture 31U.

The generally flat spring 70 is provided with a central portion 70A, upwardly inclined legs 70B and end grooved portions 70C.

To assemble the buckle with the end 31B of the strip means the tabs 33L of the buckle 33 and the generally flat spring 70 are placed beneath the end 31B in the positions shown in FIGS. 25 and 26. Then the tabs 31T of the flanges 31C are bent inwardly into the grooved portions 70C near the ends of the spring. These flanges retain the spring 70 and the pivot means tabs 33L in assembled relationships, the tabs 33L extending through the U-shaped slots 31S.

In use, the buckle is first rotated to the open position shown in FIG. 5 of the drawings. Because the pivot means 33L are each generally rectangular in cross section and of greater width than thickness when the buckle is rotated from its closed position of FIG. 26 to its open position of FIG. 5 the pivot means 33L depresses the central portion 70A of the generally flat spring means 70 and the force created by the flat spring against the pivot means is progressively increased so that when the buckle reaches its open position it is held there by engagement of the narrow sides of the pivot means with the upper surface of the central portion of the generally flat spring means.

When the buckle is rotated from its open position to its closed position of FIG. 26 the end of the tongue 33G passes through one of the registering apertures 32 of the strip means and the aperture 31U of the end 31B of the strip means. During this closing movement the spring means 70 urges the buckle to closed position by acting upon the pivot means 33L and an audible click can be heard when the buckle reaches fully closed position.

The length of the strip means 30 can be adjusted in the same way as in the first embodiment.

It will be apparent to persons skilled in the art that the buckle of this embodiment can be readily assembled with an identification bracelet which does not include a wrist watch and that it will operate in the same manner.

Products constructed according to the six embodiments shown and described in this application satisfy the long-felt need and the objects of the invention as stated above.

While six desirable embodiments of watch bands, bracelets, belts or similar articles which include spring loaded buckles embodying the invention have been described and shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

I claim:

1. A product of the character described comprising:

strip means having one end of the upper surface of which is substantially flat and is adapted to be connected to a buckle and its other end comprising a series of longitudinally spaced transverse apertures, generally flat spring means, a buckle comprising, an end portion having a substantially flat lower surface, a tongue extending forwardly and downwardly from one side thereof for engagement selectively with one of said transverse apertures of said other end of the strip means, a pair of spaced substantially flat side walls extending forwardly and downwardly from said end portion at opposite sides of said tongue, and pivot means associated with the forward ends of said side walls for connecting the buckle to said one end of said strip means, said pivot means comprising a portion which is substantially rectangular in cross section and of greater width than thickness, the upper surface of said portion of greater width being substantially parallel to the lower surface of said one end of the strip means and the lower surface of said end portion being substantially parallel to the upper surface of said other end of said strip means when the buckle is in closed position, and said generally flat spring means engaging said portion of said pivot means, whereby when the buckle is rotated from its closed position towards its open position the force exerted by said generally flat spring means against said portion of said pivot means is increased and when the buckle is in its closed position said portion of greater width is substantially parallel to both said one end and said other end of the strip means.

2. A product according to claim 1 wherein said one end of the strip means includes a transverse aperture adapted to be registered with one of said transverse apertures of said other end of the strip means and to receive the end of said tongue when said apertures are in registration.

3. A product according to claim 1 wherein said tongue is inclined downwardly from said cross piece towards a portion of said one end of said strip means.

4. A product according to claim 1 wherein a surface of said generally flat spring means engages the substantially flat surface of the portion of said pivot means which is of greater width when the buckle is in closed position.

5. A product according to claim 1 wherein a surface of said generally flat spring means engages the substantially flat surface of the portion of said pivot means which forms the thickness thereof when the buckle is in fully open position.

6. A product according to claim 1 wherein said one end of the strip means comprises an upper plate means having a unobstructed substantially smooth upper surface and a lower plate means, and means for securing them together in spaced relationship, and wherein said generally flat spring means and at least a portion of said pivot means are positioned in the space between said upper and lower plate means.

7. A product according to claim 6 wherein said upper plate means includes a transverse aperture adapted to be registered with one of the transverse apertures of said other end of the strip means and to receive the end of said tongue when said apertures are in registration.

8. A product according to claim 1 wherein said pivot means comprises a member extending between the ends of said side walls which are opposite to said end portion.

9. A product according to claim 1 wherein the ends of said side walls between which said pivot means extend comprise apertures for slideably receiving the ends of said pivot means.

10. A product according to claim 1 wherein the strip means comprises a pair of downwardly extending spaced flanges which comprise U-shaped slots for rotatably receiving said pivot means.

11. A product according to claim 10 wherein said generally flat spring means is secured to said one end by tab means extending inwardly from said spaced flanges beneath the ends of said generally flat spring means.

12. A product according to claim 10 wherein one edge of each of said downwardly extending tabs comprises a cam surface for guiding said pivot means into said U-shaped slots when it is slid along the upper surface of said flat spring means towards said slots.

13. A product according to claim 1 wherein said generally flat spring means is positioned below said pivot means in the assembled product.

14. A product according to claim 1 wherein said pivot means comprises a pair of tabs the first tab extending inwardly from one end of one of said side members and the second tab extending inwardly from one end of the other of said side members in a direction towards said first tab.

15. A product according to claim 1 wherein said one end of the strip means comprises a pair of downwardly extending spaced flanges which comprise apertures for rotatably receiving said pivot means.

16. A product according to claim 1 wherein said generally flat spring means is integral with said one end of said strip means and comprises a resilient member which extends beneath said one end for engagement with said pivot means.

17. A product according to claim 16 wherein said one end comprises a pair of spaced generally cylindrical means for rotatably receiving said pivot means.

18. A product according to claim 1 wherein said generally flat spring means comprises a plate member having centrally disposed resilient tongue means and a pair of side members each of which is provided at its end with a generally cylindrical means for rotatably receiving said pivot means.

19. A product according to claim 18 wherein said one end of said strip means comprises a loop which surrounds said generally flat spring means for connecting the buckle to said one end.

* * * * *